US007475634B2

(12) United States Patent
Barrois et al.

(10) Patent No.: US 7,475,634 B2
(45) Date of Patent: Jan. 13, 2009

(54) PRINTING PRESS COMPRISING COUPLED INKING UNIT AND PRINTING FORM CHANGING DEVICE

(75) Inventors: Claus-Dieter Barrois, Erlenbach (DE); Reinhold Dünninger, Wurzburg (DE); Brigette Dunninger, legal representative, Wurzberg (DE)

(73) Assignee: Koenig & Bauer Aktiengesellschaft, Würzburg (DE)

( * ) Notice: Subject to any disclaimer, the term of this patent is extended or adjusted under 35 U.S.C. 154(b) by 313 days.

(21) Appl. No.: 10/541,869

(22) PCT Filed: Nov. 3, 2003

(86) PCT No.: PCT/DE03/03643

§ 371 (c)(1),
(2), (4) Date: Apr. 5, 2006

(87) PCT Pub. No.: WO2004/067278

PCT Pub. Date: Aug. 12, 2004

(65) Prior Publication Data

US 2006/0236880 A1 Oct. 26, 2006

(30) Foreign Application Priority Data

Jan. 22, 2003 (DE) ..... 103 02 213

(51) Int. Cl.
*B41F 27/00* (2006.01)
*B41F 31/30* (2006.01)

(52) U.S. Cl. ..... 101/349.1; 101/477

(58) Field of Classification Search ..... None
See application file for complete search history.

(56) References Cited

U.S. PATENT DOCUMENTS

| | | | | |
|---|---|---|---|---|
| 2,012,245 | A * | 8/1935 | Meisel | 101/178 |
| 4,222,325 | A * | 9/1980 | Edwards | 101/137 |
| 4,774,883 | A | 10/1988 | Mailander | |
| 5,142,979 | A | 9/1992 | Funada et al. | |
| 6,474,231 | B1 | 11/2002 | Richards | |
| 6,487,968 | B2 * | 12/2002 | Onuma et al. | 101/463.1 |
| 6,510,795 | B1 | 1/2003 | Detmers et al. | |
| 6,553,907 | B2 | 4/2003 | Richards | |
| 6,634,292 | B2 * | 10/2003 | Fujiwara et al. | 101/141 |
| 6,684,775 | B2 | 2/2004 | Dufour et al. | |
| 2002/0005133 | A1 | 1/2002 | Detmers et al. | |

FOREIGN PATENT DOCUMENTS

| | | | |
|---|---|---|---|
| DE | 1 169 959 | | 12/1964 |
| DE | 34 46 619 | A1 | 6/1986 |
| DE | 101 22 179 | A1 | 11/2001 |
| DE | 102 21 330 | A1 | 12/2002 |
| EP | 0 949 071 | A1 | 10/1999 |
| EP | 1 176 008 | A1 | 1/2002 |
| GB | 952307 | | 11/1964 |

* cited by examiner

*Primary Examiner*—Jill E. Culler
(74) *Attorney, Agent, or Firm*—Jones, Tullar & Cooper, P.C.

(57) ABSTRACT

A printing press is comprised of at least one printing cylinder. A displaceable inking unit and a displaceable plate changing device can alternatingly be placed against the printing cylinder or can be moved out of contact with it. The inking unit and the plate changing device are coupled together so that their respective displacements are accomplished by a common drive. The two move in opposite directions with respect to the printing cylinder and may be connected together. Alternatively, each may have its own drive, with the two drives being coupled together by a common controller.

24 Claims, 6 Drawing Sheets

PRINTING PRESS COMPRISING COUPLED INKING UNIT AND PRINTING FORM CHANGING DEVICE

CROSS-REFERENCE TO RELATED APPLICATIONS

This patent application is the U.S. national phase, under 35 USC 371, of PCT/DE2003/003643, filed Nov. 3, 2003; published as WO 2004/067278 A1 on Aug. 12, 2004 and claiming priority to DE 103 02 213, filed Jan. 22, 2003, the disclosures of which are expressly incorporated herein by reference.

FIELD OF THE INVENTION

The present invention is directed to printing presses having at least one forme cylinder. An inking unit and a printing forme changing device are alternatingly moved into or out of engagement with the forme cylinder.

BACKGROUND OF THE INVENTION

A method and a device for operating a single- or a multi-color printing installation, preferably a printing press of satellite construction, is known from DE 34 46 619 A1. That printing press has at least one first stationary machine group, with a counterpressure cylinder and with preferably four transfer cylinders, as well as at least one second, displaceable machine group having at least an arrangement consisting of a forme cylinder, an inking unit and a dampening unit. An arrangement of a forme cylinder, an inking unit and a dampening unit is assigned to each transfer cylinder. The displaceable machine group contains all of these arrangements in a common frame. All of its forme cylinders can be simultaneously brought into contact or out of contact with their assigned transfer cylinders. A printing forme changing device, adapted for working together with a forme cylinder, is not provided.

A multi-color sheet-fed rotary printing press is known from DE 1 169 959 B1. An inking unit can be moved away, along an inclined track, from the assigned forme cylinder of a printing group which is fixedly arranged in place in the printing press. No printing forme changing device working together with a forme cylinder, is provided in this prior art printing press.

A printing group with a central frame section and with two lateral frames, which two lateral frames are arranged on opposite sides of the central frame section and which are movable and, in particular, which are displaceable, is known from DE 102 21 330 A1. Forme cylinders and associated transfer cylinders are arranged in the central frame section. Inking systems, which are assigned to the forme cylinders, are arranged in the lateral frames. In an operating state, in which the lateral frames are moved away from the central frame section, and thus are separated, a printing forme changing device is brought into an operative position with respect to a forme cylinder, in place of an inking unit which had been placed against this forme cylinder. A motor-driven mechanism, preferably a linear motor, is provided for the lateral frames, and a drive unit is provided for moving the printing forme changing device. The movements of the inking unit and of the printing forme changing device occur independently of each other and occur one after the other.

SUMMARY OF THE INVENTION

The object of the present invention is directed to providing printing presses with at least one forme cylinder, wherein an inking unit and a printing forme changing device can be alternatingly placed against the forme cylinder or can be moved away from it.

In accordance with the present invention, this object is attained by the provision of a printing press having at least one forme cylinder. An inking unit and a printing forme changing device are alternatingly positionable against the forme cylinder or are movable away from it. The movements of the inking unit and of the printing forme changing device are coordinated with each other, either by a common drive mechanism, by being fixedly connected with each other, or by the provision of a common control device for each of the two separate drive motors which may be used to move the two elements.

The advantages which can be gained by the present invention consist, in particular, in that it is not necessary to position both an inking unit as well as a printing forme changing device simultaneously in a structural space immediately adjoining the printing group, i.e. in the movable sections of the printing press. Since, in the course of operating the printing group, either only the printing forme changing device or only the inking unit is placed into contact with the forme cylinder at any one time, these two devices can be alternatingly brought into engagement with the forme cylinder to which they are assigned. It is advantageous if the movement of the printing forme changing device is coupled with movement of the inking unit. In that case, the printing forme changing device does not require its own transport device and requires no drive mechanisms, which leads to a simplification and to a cost reduction of the printing press. If individual drive mechanisms are provided, these individual drives are advantageously connected with each other by a common control in such a way that the printing forme changing device and the inking unit sequentially or together perform movements which are matched to each other.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
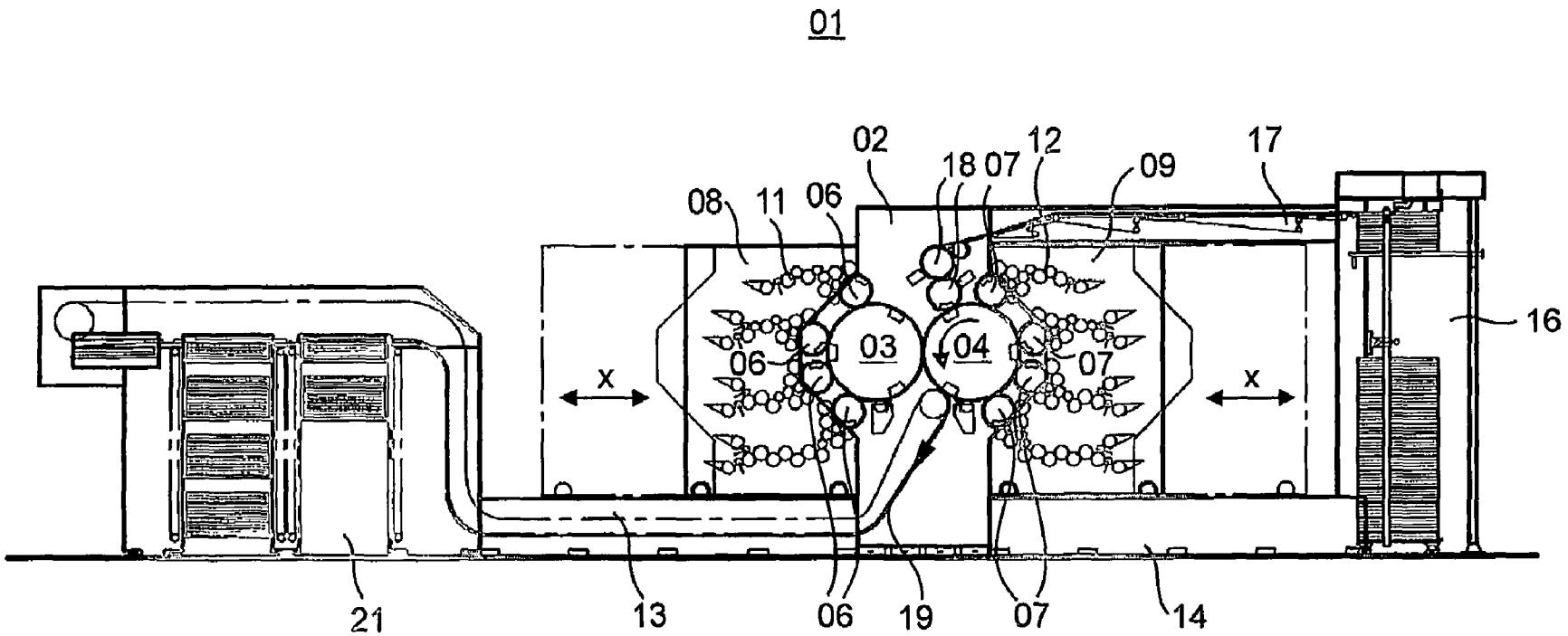
FIG. 1, a somewhat schematic side elevation view of a printing press with a stationary element and with two movable elements, wherein inking units, which are arranged in the movable elements, have been placed against forme cylinders of the printing group that are arranged in the stationary element, in FIG. 2, a side elevation view of the printing press of FIG. 1 with a stationary element containing a printing group and with two movable elements containing inking units moved away from the latter, in FIG. 3, a simplified depiction of the stationary element of the printing press with two movable elements, which two movable elements have been placed against the stationary element, and wherein each of them works together with a printing forme changing device, in FIG. 4, a simplified depiction of the stationary element of the printing press with two movable elements, which two movable elements have been moved away from the stationary element, so that a printing forme changing devices has been placed against each one, in FIG. 5, a portion of the side elevation view of the printing press of FIG. 1 with four printing forme changing devices placed horizontally against the stationary element, in FIG. 6, a portion of the side elevation view of the printing press of FIG. 2 with four printing forme changing devices placed against the stationary element and arranged in a star shape, in FIG. 7, a simplified depiction of the stationary element of the printing press with a movable element placed against it, on which a printing forme changing device has been fixedly attached, and in FIG. 8, a simplified depiction of the stationary element of the printing press with a movable element moved away from it, so that a printing forme changing device has been placed against it in its stead.
Figure 2:
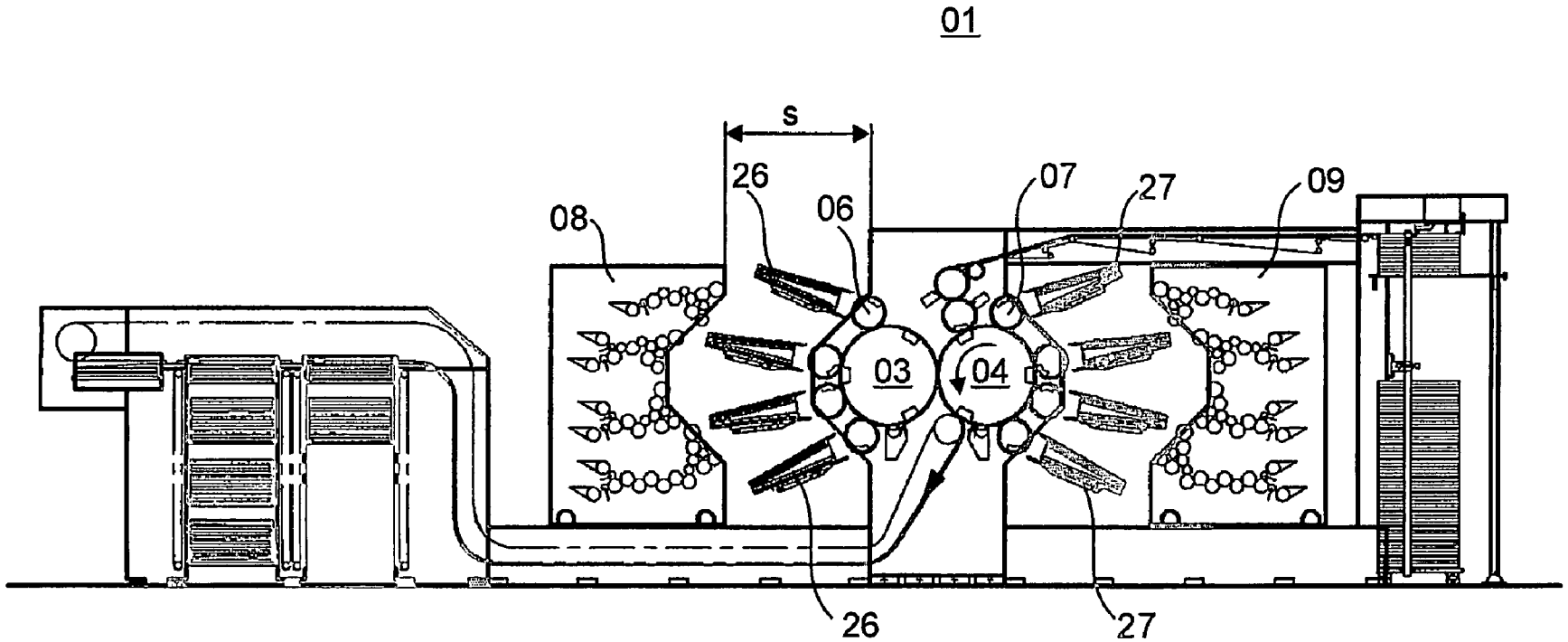

A printing press 01 is shown, by way of example, in FIGS. 1 and 2, which printing press 01 is, in this case, a sheet-fed rotary printing press with a stationary element 02. A printing group is arranged in the stationary element 02, which contains two transfer cylinders 03, 04, which two transfer cylinders 03, 04 roll off on each other in accordance with the rubber-to-rubber principle of operating, and work together with each of respectively four forme cylinders 06, 07 that are arranged in a satellite construction. Therefore, the printing press 01 has a printing group for imprinting both the front and the back of sheets to be printed. Printing press 01 can imprint both sides of a material to be imprinted simultaneously in, for example, four colors.

In the embodiment shown by way of example in FIG. 1, three dressings, and in particular three rubber printing blankets, can be placed one behind the other in the circumferential direction on each of the transfer cylinders 03, 04 of the printing press 01. The forme cylinders 06, 07 are each covered, in their circumferential direction, by a single dressing, and in particular by a single printing forme. In their axial direction, the transfer cylinders 03, 04 as well as the forme cylinders 06, 07 each have at least one dressing.

The printing press 01 has at least one element 08, 09, which is movable, in the manner of a carriage, and in which movable carriage element 08, 09 at least one inking unit 11, 12 is arranged. The inking unit 11, 12, with its associated roller arrangement, is assigned to a forme cylinder 06, 07 and can be brought into engagement with the forme cylinder 06, 07 to which it is assigned. In the example shown in FIGS. 1 and 2, two movable elements 08, 09 are provided. Each one of these movable elements 08, 09 can be positioned against, or away from the respective ones of the forme cylinders 06, 07 on a side of the stationary element 02 and extending axially with respect to the forme cylinders 06, 07. FIG. 1 shows the movable elements 08, 09 in their state in which they are both placed against the stationary element 02 and indicates, in a dash-dotted line representation, the positions of the movable elements 08, 09 in their moved-away state.

Preferably a number of inking units 11, 12, corresponding to the number of forme cylinders 06, 07, is provided in each movable element 08, 09. However, dampening units which, in particular, are assigned to the inking units 11, 12 can also be located in the movable elements 08, 09 of the printing press 01, which dampening units have not been represented in FIGS. 1 and 2 for the sake of clarity. It is easily conceivable that, because of the required arrangement of rollers in particular, dampening units would furthermore considerably reduce the limited structural space available in the movable elements 08, 09 and would, in addition, make the housing of further devices to be brought against the forme cylinders 06, 07, such as printing forme changing devices 26, 27, more difficult. Therefore, FIGS. 1 and 2 make it clear that the satellite type of construction of the printing group tends to result in very restricted space conditions in the movable elements 08, 09, if the goal is to bring devices into engagement with the forme cylinders 06, 07 arranged in the stationary element 02 of the printing press 01.

Each of the movable elements 08, 09 can be configured as a frame, for example, frame walls located opposite each other, and wherein all of the machine elements which are required for the devices to be arranged in each of the moveable elements 08, 09, such as inking unit rollers which are a part of the inking units 11, 12, ink fountains, and the like are attached, are seated or are fastened on the frame walls, and in particular, extend between them. The stationary element 02 of the printing press 01 can also include a frame assembly including, for example, two oppositely located frame walls, in which stationary element 02 frame assembly the printing unit, with all its cylinders, is arranged. Thus, the frame assemblies each constitute a mounting frame for receiving diverse machine elements and each frame assembly combines defined machine components into a structural component or into a functional unit.

The movable elements 08, 09 of the printing press 01 are each movable or displaceable, for example, in a translatory manner, by the provision of suitable transport devices 13, 14 which are assigned to them. The movement preferably extends radially, in relation to the forme cylinders 06, 07, as well as substantially horizontally in the direction indicated by the arrows x which are represented in FIG. 1. In an operational state, in which the movable elements 08, 09 are moved away from the stationary element 02, the movable elements 08, 09 of the printing press 01 will now take up a position represented in FIG. 2. The displacement path "s" of each of the movable elements 08, 09 can be 600 to 1000 mm, for example, and preferably is 800 mm.

It is furthermore possible to see, from a review of FIGS. 1 and 2, that, in the depicted example of the printing press 01, the material to be imprinted is taken, in the form of a sheet, and preferably in the form of a sheet of paper, from a stack of such sheets arranged in a sheet feeder 16, and is conveyed to the stationary element 02 of the printing press 01 by a first sheet conveying device 17. Two cooperating sheet guide drums 18, arranged in the stationary element 02 of the printing press 01, guide the material to be imprinted to the printing group, so that the material to be imprinted is passed between the two transfer cylinders 03, 04 and is thereafter picked up by a second sheet conveying device 19, such as, for example, a chain conveyor 19 for placing the material now imprinted, preferably in a stack, in a delivery device 21, which is situated at a location separated from the stationary element 02 of the printing press 01.

Printing forme changing devices 26, 27, as depicted schematically in FIG. 2, are often employed for reducing set-up times, and therefore for shortening non-productive periods of the printing press 01, and with whose aid, one or several printing formes on a forme cylinder 06, 07 can be changed. A printing forme, which is no longer needed, is removed from a forme cylinder 06, 07, preferably automatically, and typically in the course of a defined programmed process. A fresh printing forme, which has been held in readiness by the printing forme changing device 26, 27, is applied to the forme cylinder 06, 07. However, with the previously described printing press 01, it is practically almost impossible to house the required printing forme changing devices 26, 27, that are required for use with the four forme cylinders 06, 07, in the movable elements 08, 09.

For this reason, at least one movably supported printing forme changing device 26, 27 is provided, and which can be placed, alternatingly with an inking unit 11, 12, against or can be moved away from a forme cylinder 06, 07. The movements of the inking unit 11 or 12 and of the printing forme changing device 26 or 27 are coupled with each other. This means that the movements of the inking unit 11 or 12 and of the printing forme changing device 26 or 27 do not occur independently of each other. Instead, the inking unit 11, 12 and the printing forme changing device 26, 27 are connected with each other so that they will always act together in such a way that the movements of the inking unit 11, 12 and of the printing forme changing device 26, 27, which movements are aimed in opposite directions away from and toward the forme cylinder 06, 07, take place simultaneously.

For example, it is possible to provide several different printing forme changing devices 26, 27 in connection with every movable element 08,09 of the printing press 01, and wherein each one of the printing forme changing devices 26, 27 acts together with one of the inking units 11, 12 which is arranged in the movable elements 08, 09. The printing forme changing devices 26, 27 are preferably arranged on the driven side of the printing press 01.

Figure 3:
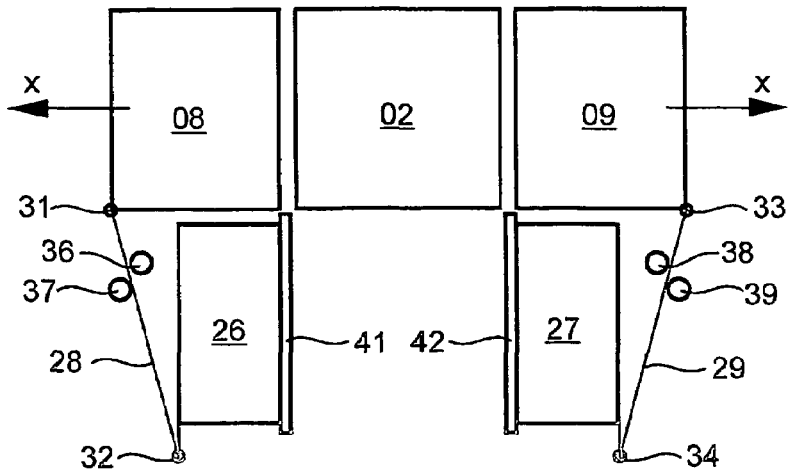
Figure 4:
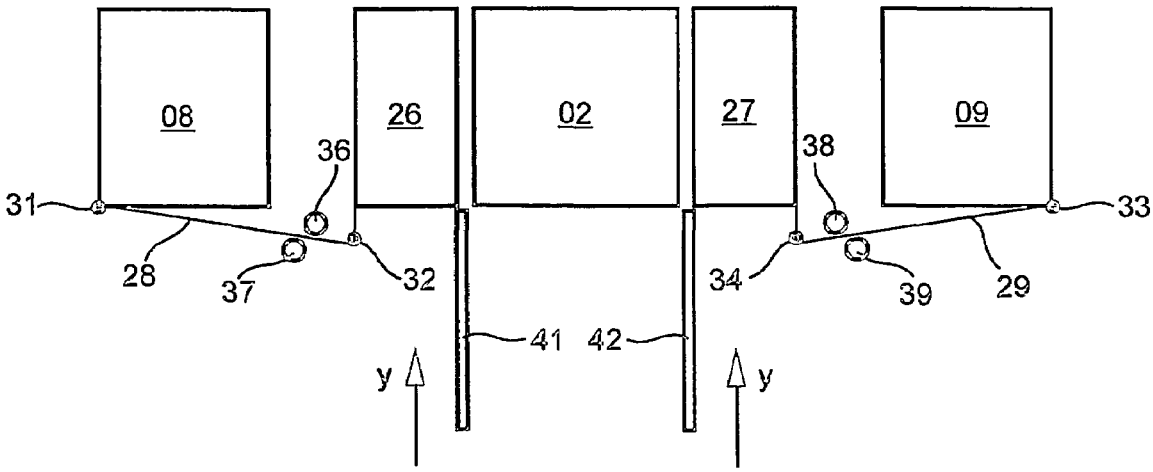

The combined action of a printing forme changing device 26, 27 and of an associated inking unit 11, 12 is represented by way of example in FIGS. 3 and 4 in the form of simplified schematic drawings. FIGS. 3 and 4 each show, in a top plan view, the stationary element 02 of the printing press 01, and against both sides of which a movable element 08, 09 has been placed, as depicted in FIG. 3, or has been moved away, as depicted in FIG. 4. In this depicted embodiment, each movable element 08, 09 is connected with at least one printing forme changing device 26, 27. The printing forme changing devices 26, 27 each act together with an inking unit 11, 12 which is arranged in the movable element 08, 09, and are connected, for example by push rods 28, 29, that are seated in joints 31, 32, 33, 34, with the movable element 08, 09. If a movable element 08, 09 is moved away from the stationary element 02 of the printing press 01, i.e. if a movable element 08, 09 is moved by being displaced in the arrow direction x, as indicated in FIG. 3, one of the printing forme changing devices 26, 27 is placed against an associated forme cylinder 06, 07 in the stationary element 02 in place of the inking unit 11, 12. In this preferred embodiment, the movements of the printing forme changing devices 26, 27 and of the inking units 11, 12, which printing units 11, 12 are arranged fixed in place in the movable elements 08, 09, are coupled with each other, so that the printing forme changing devices 26, 27 and the inking units 11, 12 can be alternatingly placed against, or can be moved away from the forme cylinder 06, 07.

A mechanically operated guidance of these alternating elements is accomplished with the aid of rollers 36, 37, 38, 39, which, as seen in FIGS. 3 and 4, are arranged in pairs and are fixed in place with respect to the printing press 01. Push rods 28, 29 are, for example, respectively guided in a gap formed between two cooperating rollers 36 and 37 or 38 and 39. Guide elements 41, 42 are also provided, for example, in the form of telescoping rails, on each of which guide elements 41, 42 one of the printing forme changing devices 26, 27 is respectively fastened. By moving a movable element 08, 09 in the arrow direction x, the printing forme changing device 26, 27 connected, or associated with that movable element 08, 09 is forcibly displaced along the arrow direction y, as seen in FIG. 4, along the guide elements 41, 42. Because of this movement, the printing forme changing device 26, 27 comes into engagement with its associated forme cylinder 06, 07. The printing forme changing device 26, 27 is now in its working position, in which working position a printing forme can be exchanged between the forme cylinder 06, 07 and the printing forme changing device 26, 27. It is possible, in a corresponding manner, to return the printing forme changing device 26, 27 into its position of rest, as depicted in FIG. 3, in the course of which return movement, an inking unit 11, 12 is again automatically placed against the forme cylinder 06, 07.

Figure 5:
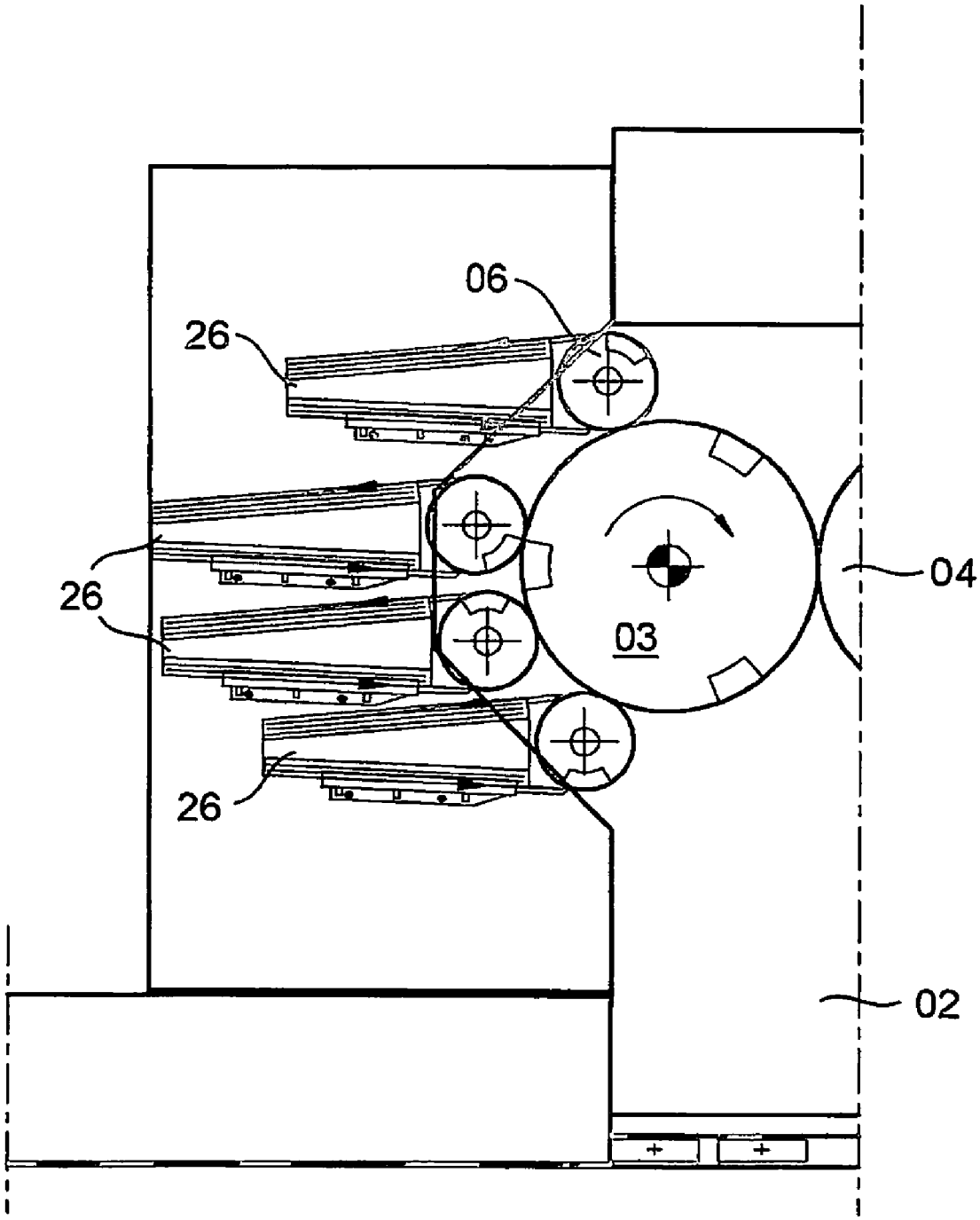
Figure 6:
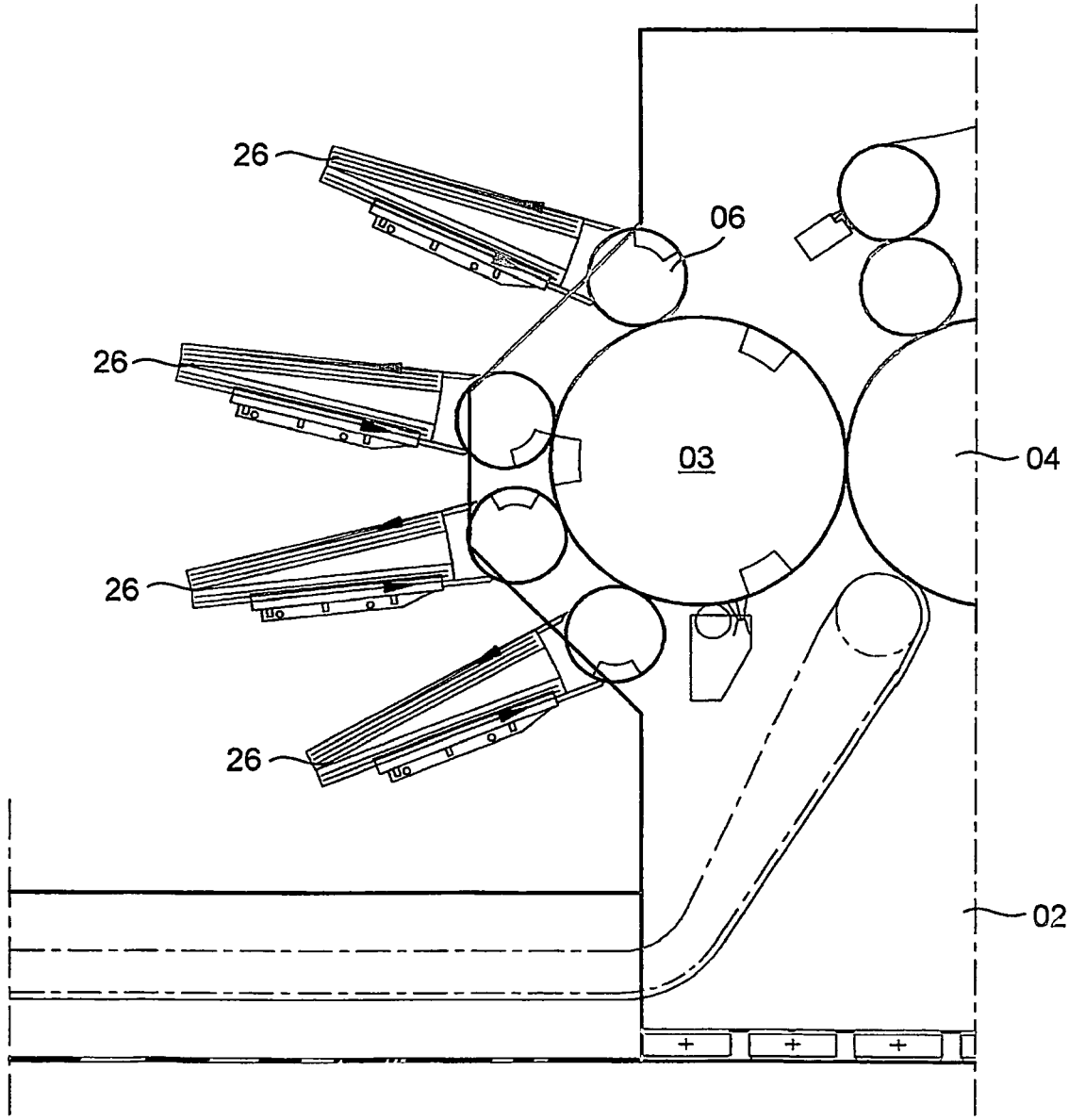

In the side elevation view of FIG. 5 there is shown a portion of the printing press 01 represented in FIG. 1, and with four printing forme changing devices 26, which have been placed against the respective forme cylinders 06 assigned to them in the stationary element 02. In the embodiment shown in FIG. 5, the printing forme changing devices 26 are arranged horizontally and are substantially parallel with respect to each other, at least in their working position. However, as previously depicted in FIG. 2, the printing forme changing devices 26, 27 can also be aligned, in their working positions, in a radially extending or star shape, for example, with respect to the forme cylinders 06, 07 which are arranged in the stationary element 02. This radial or star-shaped positioning can also be seen in FIG. 6, which depicts an enlarged partial portion of FIG. 2.

Figure 7:
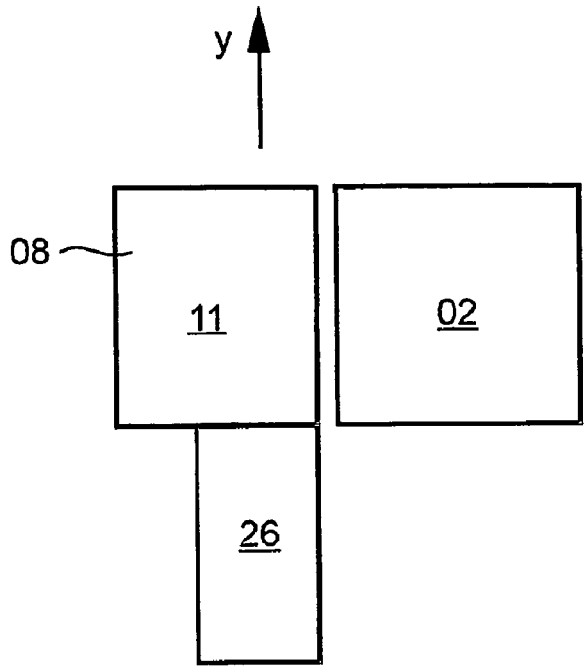
Figure 8:
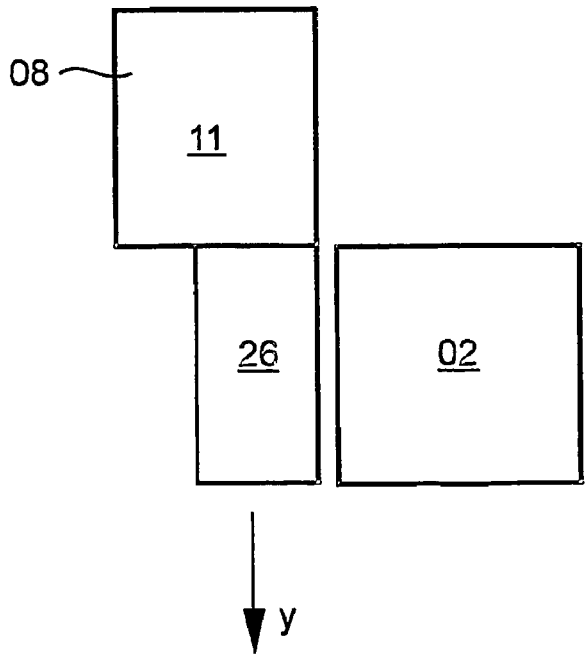

It is also possible to provide, as represented in FIGS. 7 and 8 in the form of further simplified schematic depictions, for the movable elements 08, 09, with the inking units 11, 12 arranged in them, and for the associated printing form changing devices 26, 27 to be fixedly connected with each other. Each such rigid combination of a printing forme changing device 26 and an inking unit 11 can be displaced in the axial direction with respect to the associated forme cylinder 06, in the arrow direction y shown in FIGS. 7 and 8, so that the printing forme changing device 26 and the inking unit 11 alternatingly come into engagement with the forme cylinder 06 that is arranged in the stationary element 02.

It is common to the several disclosed preferred embodiments of the subject invention that a defined inking unit 11, 12 and a defined printing forme changing device 26, 27 can always be alternatingly brought into engagement with a defined forme cylinder 06, 07 to which they are assigned only selectively in turn, and thus, as indicated above, alternatingly, and not at the same time. For this purpose, the movement required for bringing the inking unit 11, 12 into and out of contact is preferably cooperatively coupled with the movement required of the printing forme changing device 26, 27 to bring it into and out of contact.

This cooperative coupling can advantageously be realized by a forced mechanical guidance device, so that a drive mechanism, which is required for the movement of the inking unit 11, 12, is also used for the movement of the printing forme changing device 26, 27. The employment of the drive mechanism of the inking unit 11, 12 to also accomplish the movement of the printing forme changing device 26, 27 is easily possible, as a rule, because the inking unit 11, 12 is preferably arranged in a movable element 08, 09 of the printing press 01, and wherein that movable element 08, 09, which preferably consists of a frame with various roller devices arranged therein, has a substantially much greater mass than the printing forme changing device 26, 27 which is connected with it. The mass of the movable element 08, 09 and the mass of the printing forme changing device 26, 27 associated with it can be at a ratio of 30:1 or greater, for example. In actual operations, drive mechanisms, of suitable output classes, are used for the required mass acceleration. The drive mechanism made available for the movement of the movable elements 08, 09, and therefore also of the inking unit 11, 12, has sufficient output reserves for easily taking on the movement of the printing forme changing device 26, 27 in addition to the movement of the inking unit 11, 12.

It is also possible, in accordance with the present invention, to provide the printing forme changing device 26, 27 with its own drive mechanism for accomplishing its movement. This separate drive mechanism may be, for example, an actuating drive, whose control device takes into consideration the movement of the movable element 08, 09. A coupling of the movement is realized, by use of the control device, wherein the control can take place, for example, electrically, electronically or pneumatically. Thus, the control device preferably includes a program-controlled run-off control which, for the individual drive mechanisms, takes into consideration the dependence of the movement of the printing forme changing device 26, 27 on the movement of the movable elements 08, 09. Accordingly, their movements, which are performed in sequence or simultaneously, are matched to each other, as needed, with the aim of reducing set-up times and therefore also reducing non-productive times of the printing press 01.

While preferred embodiments of printing presses comprising at least one printing cylinder, in accordance with the present invention, have been set forth fully and completely hereinabove, it will be apparent to one of skill in the art that various changes in, for example, the drives for the transfer and forme cylinders, the specific structures of the inking units and of the printing forme changing devices, and the like could be made without departing from the true spirit and scope of the present invention, which is accordingly to be limited only by the appended claims.

What is claimed is:

1. A printing press comprising:

at least one forme cylinder;

at least one inking unit selectively positionable in a first inking unit position adjacent said forme cylinder and a second inking unit position remote from said forme cylinder;

at least one printing forme changing device selectively positionable in a first printing forme changing device position remote from said forme cylinder and a second printing forme changing device position adjacent said forme cylinder; and means coupling said at least one inking unit and said at least one printing forme changing device wherein a movement of one of said inking unit and said printing forme changing device between its respective first and second positions results in a movement of the other of said inking unit and said printing forme changing device between its first and second positions.

2. The printing press of claim 1 wherein said at least one inking unit and said at least one printing forme changing device are fixedly connected with each other.

3. The printing press of claim 1 further including a stationary printing press element supporting said at least one forme cylinder, and a movable printing press element supporting said at least one inking unit.

4. The printing press of claim 3 wherein said at least one printing forme changing device is attached to said movable printing press element.

5. The printing press of claim 3 further including a drive mechanism for moving said movable printing press element and said printing forme changing device.

6. The printing press of claim 3 further including a first drive mechanism for said movable printing press element and a second drive mechanism for said printing forme changing device and further including a common control device for said first and second drive mechanism, said common control device controlling said first and second drive mechanisms for controlling movement of said printing forme changing device as a function of movement of said movable printing press element whereby said printing forme changing device and said movable printing press element movements are matched to each other.

7. The printing press of claim 3 further including a plurality of said forme cylinders in said stationary printing press element and a corresponding plurality of said inking units in said movable printing press element.

8. The printing press of claim 7 wherein said plurality of said inking units are supported in said movable printing press element for movement with respect to said plurality of associated forme cylinders concurrently.

9. The printing press of claim 7 wherein said plurality of inking units in said movable printing press element are seated in a common frame.

10. The printing press of claim 3 further including a plurality of said printing forme changing devices in operational contact with said movable printing press element.

11. The printing press of claim 10 wherein all of said printing forme changing devices are parallel to each other.

12. The printing press of claim 10 wherein all of said printing forme changing devices are arranged in a star shape with respect to said stationary printing press element.

13. The printing press of claim 10 further including a plurality of printing formes in said stationary element and wherein said plurality of printing forme changing devices act together with said plurality of forme cylinders.

14. The printing press of claim 3 wherein said movable printing press element moves in one of a radial and an axial direction with respect to said stationary printing press element.

15. The printing press of claim 3 wherein said movable printing press element movement is linear.

16. The printing press of claim 1 wherein when said printing forme changing device is in said first printing forme changing device position, said inking unit is in said first inking unit position.

17. The printing press of claim 1 wherein when said printing forme changing device is in said second printing forme changing device position, said inking unit is in said second inking unit position.

18. The printing press of claim 1 further including a transfer cylinder and a plurality of said forme cylinders arranged around said transfer cylinder in satellite construction.

19. The printing press of claim 1 further including a driven side of said printing press, said at least one printing forme changing device being located at said driven side of said printing press.

20. The printing press of claim 1 wherein said at least one printing forme changing device moves in an axial direction of said forme cylinder.

21. The printing press of claim 1 further including at least one guide element, said at least one printing forme changing device being fastened on said at least one guide element.

22. A printing press comprising:

at least one forme cylinder;

at least one inking unit selectively positionable in a first inking unit position adjacent said forme cylinder and a second inking unit position remote from said forme cylinder:

at least one printing forme changing device selectively positionable in a first printing forme changing device position remote from said forme cylinder and a second printing forme changing device position adjacent said forme cylinder:

means coupling said at least one inking unit and said at least one printing forme changing device wherein a movement of one of said inking unit and said printing forme changing device between its respective first and second positions results in a movement of the other of said inking unit and said printing forme changing device between its respective first and second positions;

a stationary printing press element supporting said at least one forme cylinder, and a movable printing press element supporting said at least one inking unit: and a forced guidance device provided between said movable printing press element and said printing forme changing device, said forced guidance coupling said movable printing press element and said printing forme changing device.

23. The printing press of claim 22 wherein said forced guidance device includes at least one push rod and a pair of guide rollers defining a gap, said pair of guide rollers being fixed with respect to said printing press, said at least one push rod being guided for movement in said gap.

24. A printing press comprising:

at least one forme cylinder;

at least one inking unit selectively positionable in a first inking unit position adjacent said forme cylinder and a second inking unit position remote from said forme cylinder;

at least one printing forme changing device selectively positionable in a first printing forme changing device position remote from said forme cylinder and a second printing forme changing device position adjacent said forme cylinder;

means coupling said at least one inking unit and said at least one printing forme changing device wherein a movement of one of said inking unit and said printing forme changing device between its respective first and second positions results in a movement of the other of said inking unit and said printing forme changing device between its respective first and second positions; and a common drive mechanism for said at least one inking unit and said at least one printing forme changing device.

* * * * *